US010391616B1

(12) United States Patent
Cantlon

(10) Patent No.: US 10,391,616 B1
(45) Date of Patent: Aug. 27, 2019

(54) TOOL CONNECTOR ASSEMBLY

(71) Applicant: Jore Corporation, Ronan, MT (US)

(72) Inventor: Nathan C. Cantlon, Charlo, MT (US)

(73) Assignee: Jore Corporation, Ronan, MT (US)

( * ) Notice: Subject to any disclaimer, the term of this patent is extended or adjusted under 35 U.S.C. 154(b) by 201 days.

(21) Appl. No.: 15/416,266

(22) Filed: Jan. 26, 2017

(51) Int. Cl.
*B25B 23/00* (2006.01)

(52) U.S. Cl.
CPC ..... *B25B 23/0014* (2013.01); *B25B 23/0035* (2013.01)

(58) Field of Classification Search
CPC ..... B25B 23/0014; B25B 23/0042; B25B 23/0035; B25G 3/38
See application file for complete search history.

(56) References Cited

U.S. PATENT DOCUMENTS 1,392,220 A * 9/1921 Quint ..... B25B 23/0014 279/24
3,897,703 A 8/1975 Phipps
4,065,941 A 1/1978 Aoki
4,188,801 A 2/1980 Hugh et al.
4,832,657 A 5/1989 Hahn
4,936,701 A 6/1990 Allen et al.
5,851,151 A 12/1998 Reynolds
6,347,564 B1 * 2/2002 Ciocca ..... B25B 15/02 81/177.7
6,386,074 B1 * 5/2002 Yang ..... B25B 13/481 81/177.7
7,278,342 B1 * 10/2007 Chang ..... B25B 15/001 81/177.75
7,430,943 B2 * 10/2008 Chiang ..... B25B 23/0028 81/177.1
7,597,031 B2 * 10/2009 Chiang ..... B25B 23/0028 81/177.1
8,001,873 B2 * 8/2011 Peng ..... B25B 23/0014 403/57
8,104,382 B2 * 1/2012 Hu ..... B25B 23/0014 403/57
8,403,763 B2 3/2013 Hu
8,733,216 B1 5/2014 Cantlon
8,915,788 B2 * 12/2014 Foote ..... F16D 3/24 464/141

(Continued)

OTHER PUBLICATIONS

Apex® Industrial Fastener Tools Catalog, Apex Tool Group, LLC, Apex, N.C., © 2012, 99 pages.

(Continued)

*Primary Examiner* — David B. Thomas
(74) *Attorney, Agent, or Firm* — Christensen O'Connor Johnson Kindness PLLC; Margie Aoki

(57) ABSTRACT

A tool connector assembly for transmission of off-axis torque from a power tool includes a first drive shaft having a first end configured to be secured within a power tool and a second end defining a ball portion and a second drive shaft having a first end defining a cup-shaped cavity configured to receive the ball portion such that the ball portion is moveable against a surface of the cup-shaped cavity for moveably coupling the first drive shaft to the second drive shaft, wherein the second drive shaft further includes a second end defining an internal cavity configured to receive a tool bit. A hub collar is received on the second drive shaft and is rotatable about a longitudinal axis of the second drive shaft.

19 Claims, 9 Drawing Sheets

(56) References Cited

U.S. PATENT DOCUMENTS

| | | | | |
|---|---|---|---|---|
| 8,956,236 | B2 * | 2/2015 | Chu | F16C 11/0647 411/517 |
| 9,101,987 | B2 | 8/2015 | Cornwell et al. | |
| 9,205,543 | B1 * | 12/2015 | Chen | B25B 23/0035 |
| 9,776,310 | B2 * | 10/2017 | Chen | B25B 23/0028 |
| 2002/0083801 | A1 * | 7/2002 | Cheng | B25B 13/06 81/177.75 |
| 2004/0040423 | A1 * | 3/2004 | Hung | B25B 15/02 81/177.75 |
| 2006/0260446 | A1 * | 11/2006 | Chang | B25B 23/0028 81/177.75 |
| 2012/0321374 | A1 * | 12/2012 | Ray | B25B 23/0014 403/111 |
| 2016/0265596 | A1 * | 9/2016 | Yu | B25B 23/0035 |
| 2017/0254365 | A1 * | 9/2017 | Chen | F16D 3/221 |

OTHER PUBLICATIONS

DeWalt 1/4 in. Hex MAXFIT Pivot Holder, Model No. DVAPVTMF, Aug. 24, 2015, <https://web.archive.org/web/20150824075712/http://www.homedepot.com/p/DEWALT-1-4-in-Hex-MAXFIT-Pivot-Holder-DWAPVTMF/205997269> [retrieved Feb. 2, 2017], 2 pages.

* cited by examiner

TOOL CONNECTOR ASSEMBLY

BACKGROUND

As is well known, a rotary impact tool includes a drive mechanism that uses rotating mass to store kinetic energy. This rotating mass is momentarily coupled at high velocity to impact the "anvil" or output side of the drive train. The rapid succession of these small impacts results in an intermittent rotation of the anvil. These impacts impart a very high momentary force (i.e., "whack") on the drive train, and in turn, any other accessory being driven by the tool.

The high power drive mechanism of rotary impact tools make them suitable for driving and remove fasteners, such as bolts or nuts used in machine or automotive applications. Such applications often require specific precise alignment of the fastener for properly threading the fastener into its designated cavity. Misalignment while driving the fastener into a cavity can cause cross threading and or rounding of the fastener's head, leaving an inoperable assembly and a damaged fastener. Therefore, impact tool drive accessories that help to aid and maintain alignment of a fastener such as a bolt or nut have been developed. Such "off-axis" tool drive accessories are suitable for delivery torque to the fastener at an angle offset from the impact tool longitudinal axis. The drive accessories may include a universal joint, ball joint, etc., that couples the fastener to the impact tool and allows the fastener to be driven at an angle from the impact tool.

These off-axis tool accessories have been specifically designed for rotary impact tools, which, as is well known in the art, are powerful but mechanically inefficient, and therefore have been traditionally powered by compressed air. However, improvements in power and motor technology have helped to offset this inefficiency, allowing cordless electric impact tools to gain an increasing presence in the tool market.

Cordless electric impact tools, though suitable for many uses, may be used in applications similar to traditional cordless drills. However, the tool accessories available for traditional (compressed air powered) rotary impact tools have not been designed for cordless tool applications. Moreover, the tool accessories available for traditional cordless drills are typically unsuitable for the high momentary torque loads of a rotary impact tool. As such, there is a need for accessories that are specifically tailored for use with cordless high momentary torque tools, such as cordless impact tools and the like. Such an accessory should allow for off-axis deflection to drive and remove fasteners at an angle offset from the impact tool longitudinal axis.

SUMMARY

A tool connector assembly for transmission of off-axis torque from a power tool includes a first drive shaft having a first end configured to be secured within a power tool and a second end defining a ball portion and a second drive shaft having a first end defining a cup-shaped cavity configured to receive the ball portion such that the ball portion is moveable against a surface of the cup-shaped cavity for moveably coupling the first drive shaft to the second drive shaft, wherein the second drive shaft further includes a second end defining an internal cavity configured to receive a tool bit. A hub collar is received on the second drive shaft and is rotatable about a longitudinal axis of the second drive shaft.

In another aspect, a tool connector assembly for transmission of off-axis torque from a power tool includes a first drive shaft having a first end configured to be secured within a power tool and a second end defining a first ball portion, and a second drive shaft having a first end defining a first cup-shaped cavity configured to receive the first ball portion such that the first ball portion is moveable against a surface of the first cup-shaped cavity for moveably coupling the first drive shaft to the second drive shaft, wherein second drive shaft also includes a second end defining a second ball portion. The tool connector assembly further includes a third drive shaft having a first end defining a second cup-shaped cavity configured to receive the second ball portion such that the second ball portion is moveable against a surface of the second cup-shaped cavity for moveably coupling the second drive shaft to the third drive shaft, wherein the third drive shaft also includes a second end defining an internal cavity configured to receive a tool bit. A first hub collar is received on the third drive shaft and rotatable about a longitudinal axis of the third drive shaft.

In another aspect, a tool connector assembly for transmission of off-axis torque from a power tool includes a first drive shaft having a first end configured to be secured within a power tool and a second end defining a first cup-shaped cavity, and a second drive shaft having a first end defining a second cup-shaped cavity and a second end defining an internal cavity configured to receive a tool bit. A third drive shaft having a first end defining a first ball portion is moveably receivable within the first cup-shaped cavity such that the first ball portion is moveable against a surface of the first cup-shaped cavity for moveably coupling the third drive shaft to the first drive shaft, and a second end of the third drive shaft defining a second ball portion is moveably receivable within the second cup-shaped cavity such that the second ball portion is moveable against a surface of the second cup-shaped cavity for moveably coupling the third drive shaft to the second drive shaft. A first hub collar is received on the second drive shaft and is rotatable about a longitudinal axis of the second drive shaft.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Figure 1:
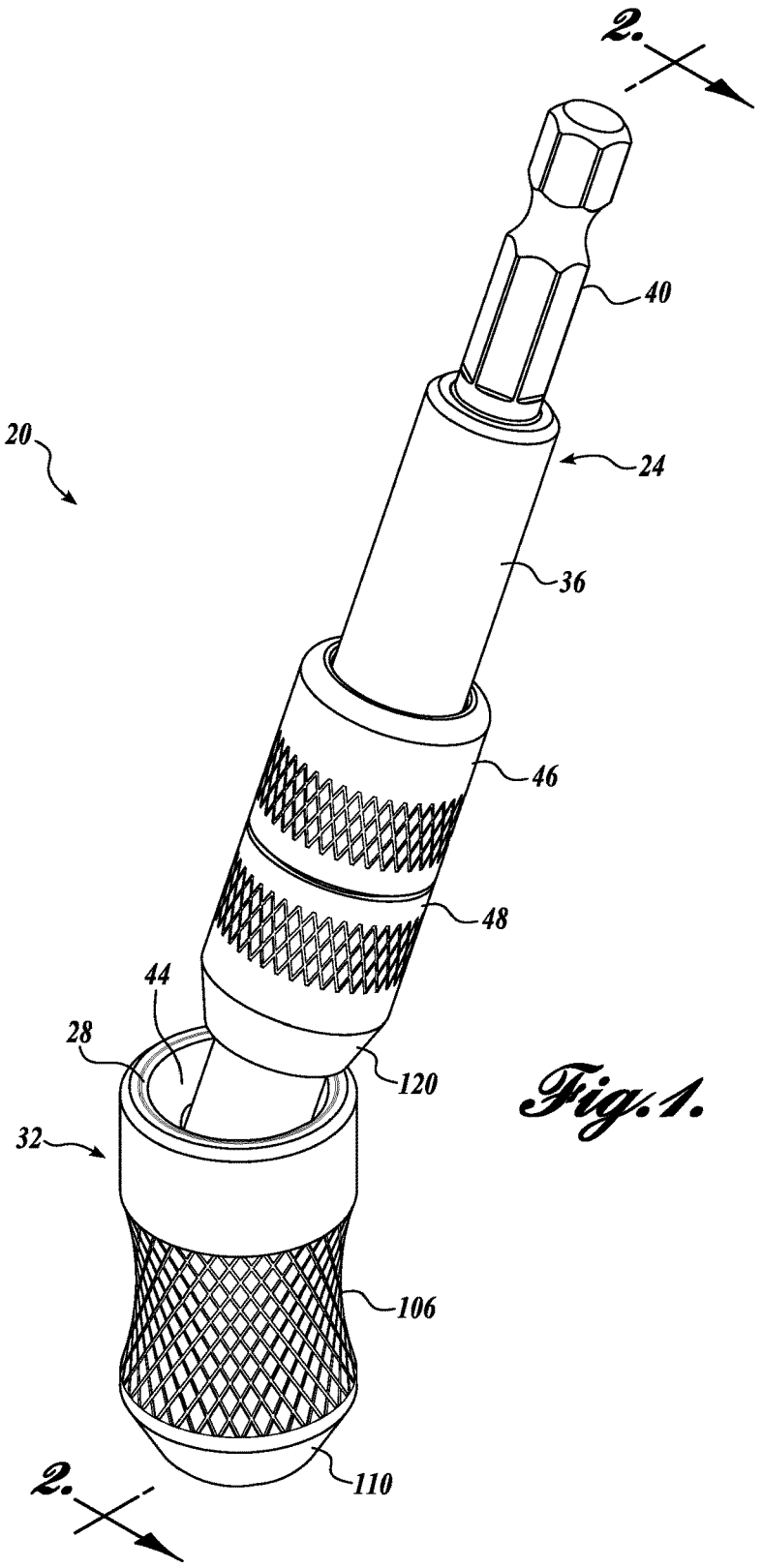
FIG. 1 is an isometric environmental view of a tool connector assembly formed in accordance with a first exemplary embodiment of the present disclosure.
Figure 2:
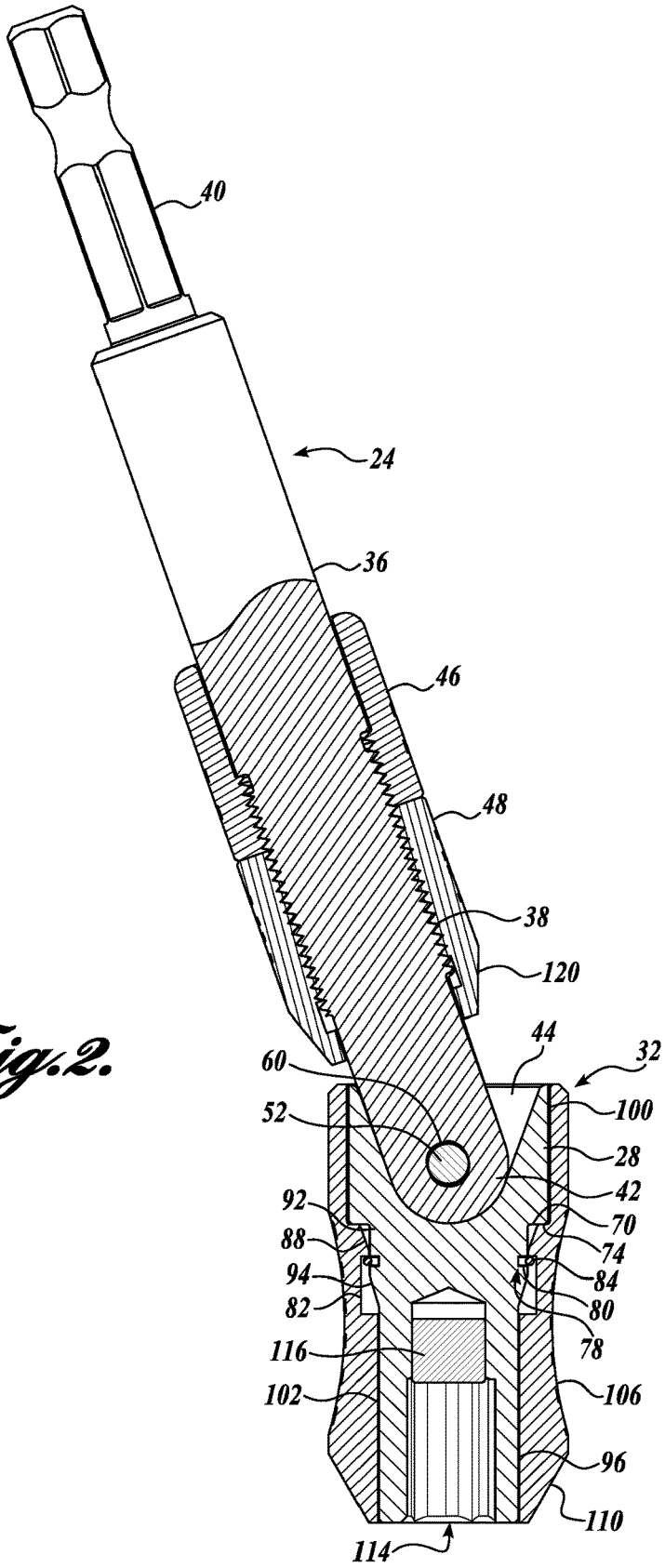
FIG. 2 is a cross-sectional view of the tool connector assembly of FIG. 1, taken substantially across line 2-2.
Figure 3:
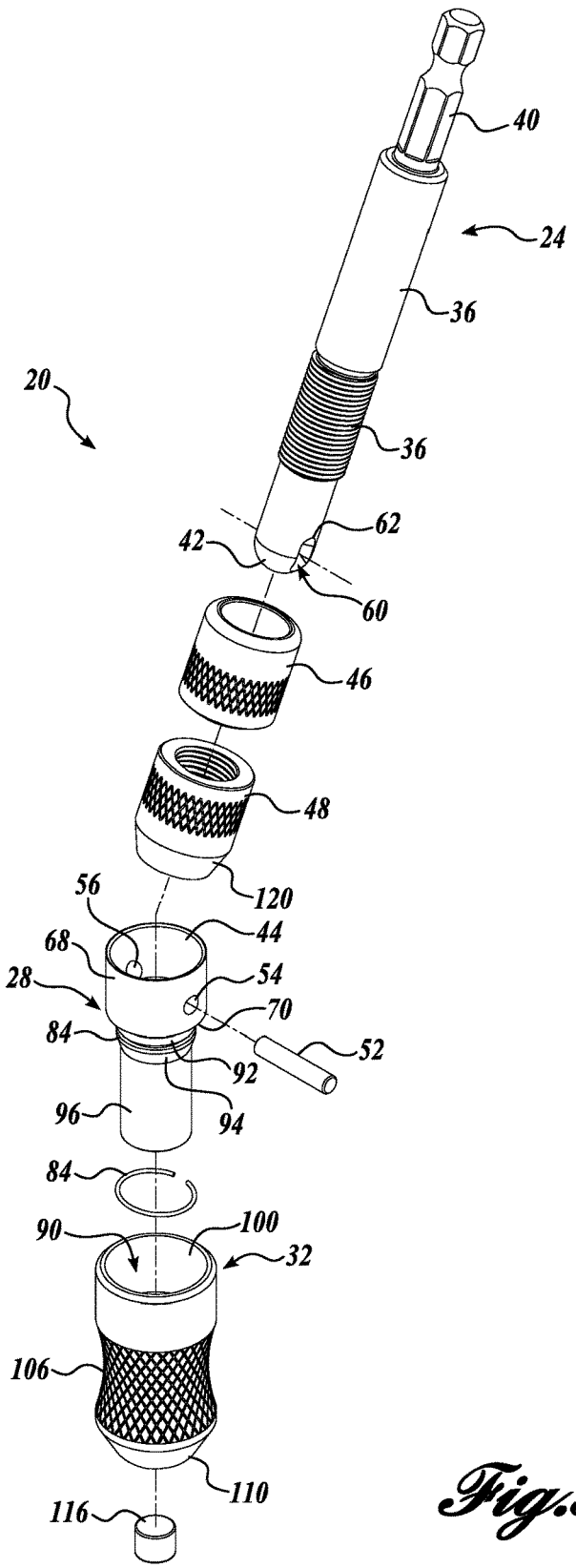
FIG. 3 is an exploded view of the tool connector assembly of FIG. 1.

Referring to the FIGURES, an exemplary embodiment of a quick change tool connector assembly 20 formed in accordance with the present disclosure will now be described. The tool connector assembly 20 is suitable for use with high momentary torque power tools, such as cordless impact drivers. However, it should be appreciated that the tool connector assembly 20 may instead be used with any suitable power tool, such as cordless drivers or the like.

The tool connector assembly 20 generally includes a first drive shaft 24 movably coupled to a second drive shaft 28, wherein the first drive shaft 24 is connectable to a power tool, and the second drive shaft 28 is configured to removably receive a tool bit or otherwise define a tool end for completing a mechanical task. The first drive shaft 24 may be positioned out of coaxial alignment with the second drive shaft 28 (or vice versa) for driving and removing fasteners or the like at an angle from a power tool. A hub collar 32 is rotatably secured on the second drive shaft 28 and is graspable by a user to stabilize and control the tool connector assembly 20 as it is used to impart an off-axis force against a fastener, such as a screw.

The first drive shaft 24 of the tool connector assembly 20 will now be described in detail. The first drive shaft 24 includes a tool attachment portion 40 defined at a first end that is generally configured for attaching to a power tool, such as an impact driver, a standard hand drill, or similar tool. More specifically, the tool attachment portion 40 is suitably sized and shaped to be received and retained within the receptacle or chuck of a power tool. In that regard, the tool attachment portion may be hex-shaped or any other suitable polygonal shape that corresponds to the receptacle or chuck of a power tool.

An elongated body portion 36 extends coaxially from the tool attachment portion 40 a suitable, predetermined length for allowing a user to accomplish a desired task. Accordingly, it can be appreciated that the elongated body portion 36 may be shortened or elongated as necessary for the intended use. Moreover, the elongated body portion 36 is generally cylindrical in shape for ease of use and for rotatably receiving first and second locking collars 46 and 48 thereon (later described), however; any suitable shape may be used. In that regard, the elongated body portion 36 includes a threaded body portion 38 defined near a second end of the first drive shaft 24 and extending axially along the elongated body portion 36 that is configured to threadably receive the first and second locking collars 46 and 48 thereon and position them for engagement with the second drive shaft 28. In some embodiments, as will later become appreciated, the first and second locking collars 46 and 48 are not included, and in such embodiments, the threaded body portion 38 would be eliminated.

The second end of the first drive shaft 24 (at the distal end of the elongated body portion 36) terminates in a ball portion 42 configured to be movably received within a cup-shaped cavity 44 defined within a first end of the second drive shaft 28. The cup-shaped cavity 44 is suitably sized and configured for receiving the ball portion 42 of the first drive shaft 24 to define a universal ball and socket type joint between the first and second drive shafts 24 and 28. The cup-shaped cavity 44 extends downwardly into the first end of the second drive shaft 28 and is generally defined by tapering cylindrical walls terminating in a spherical bottom. In that regard, the ball portion 42 is suitable shaped and sized to be received within and moveable against the spherical bottom of the cup-shaped cavity 44 to move the first drive shaft 24 out of coaxial alignment with the second drive shaft 28. At the same time, the ball portion 42 and cup-shaped cavity 44 are correspondingly shaped and sized to substantially maintain physical contact between the ball portion 42 and the cup-shaped cavity 44 as the first drive shaft 24 is moved out of axial alignment with the second drive shaft 28. It should be appreciated that instead of moving the first drive shaft 24, the second drive shaft 28 may instead be moved out of axial alignment with the first drive shaft 24.

A cross pin 52 may be used to secure the ball portion 42 within the cup-shaped cavity 44 and to allow the first drive shaft 24 to move relative to the second drive shaft 28. More specifically, cross pin 52 extends diametrically through a cross pin slot 60 defined in the ball portion 42 and is received within first and second cylindrical holes 54 and 56 extending within the interior wall of the second drive shaft 28 substantially transversely to the longitudinal axis of the second drive shaft 28. When received within the first and second cylindrical holes 54 and 56, the cross pin 52 retains the ball portion 42 within the cup-shaped cavity 44.

Figures 4A, 4B, 4C:
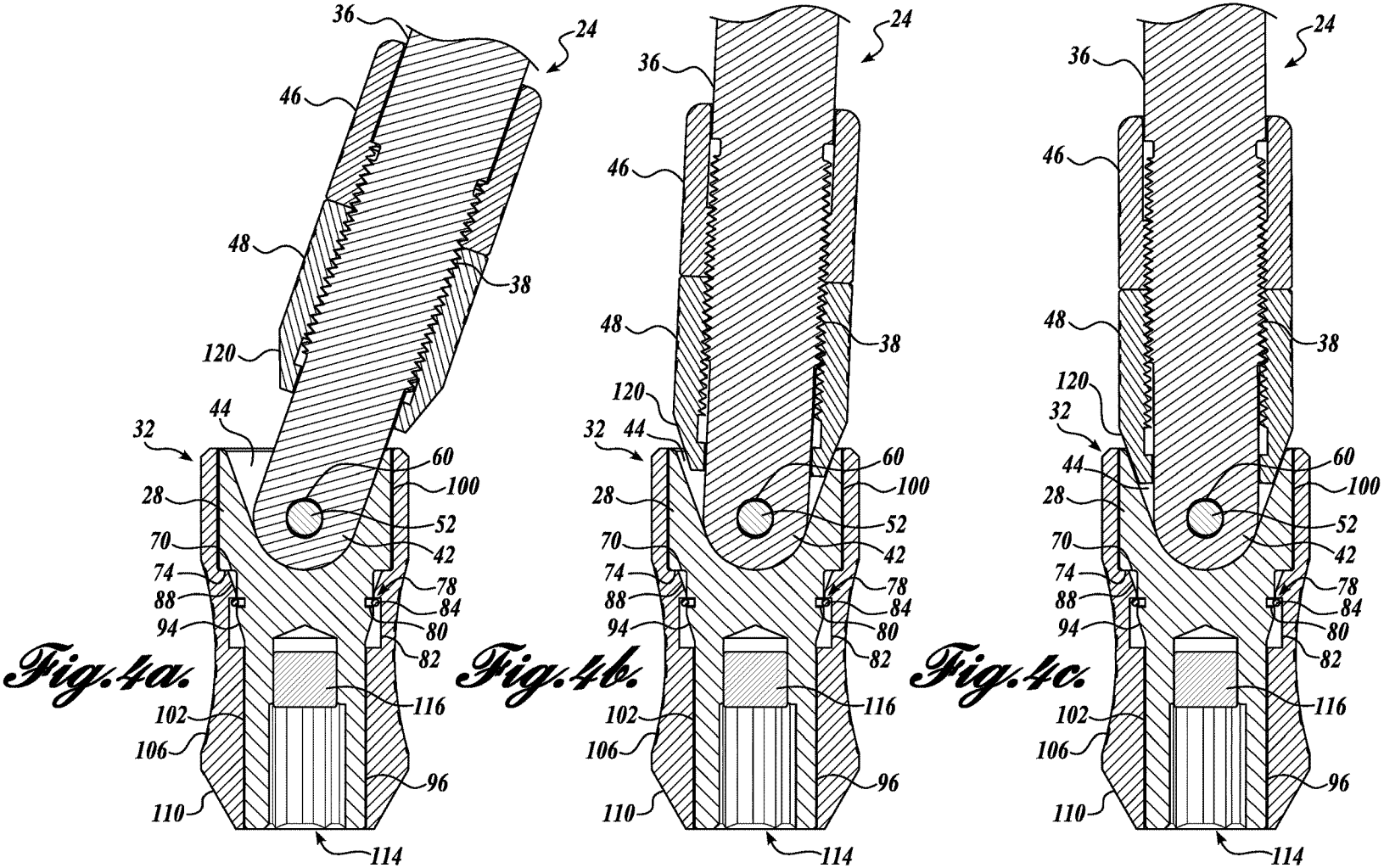
FIG. 4A is a partial cross-sectional view of the tool connector assembly of FIG. 1, wherein the tool connector assembly is shown in a first position.
FIG. 4B is a partial cross-sectional view of the tool connector assembly of FIG. 1, wherein the quick change connector assembly is shown in a second position.
FIG. 4C is a partial cross-sectional view of the tool connector assembly of FIG. 1, wherein the tool connector assembly is shown in a third position.
Figure 5C:
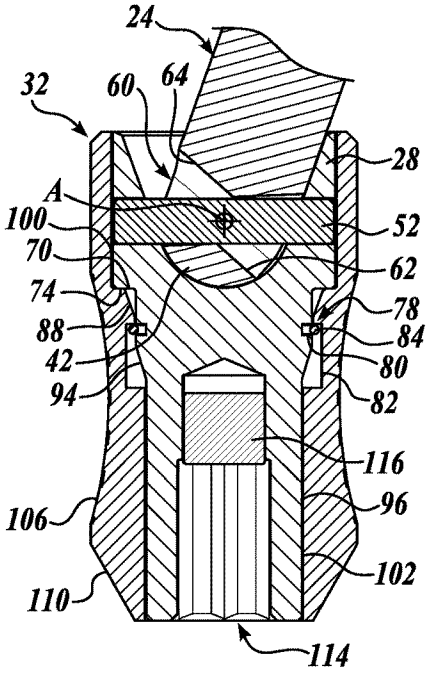
FIG. 5C is a partial cross-sectional view of the tool connector assembly of FIG. 1, wherein the tool connector assembly is shown in a sixth position.
Figure 5B:
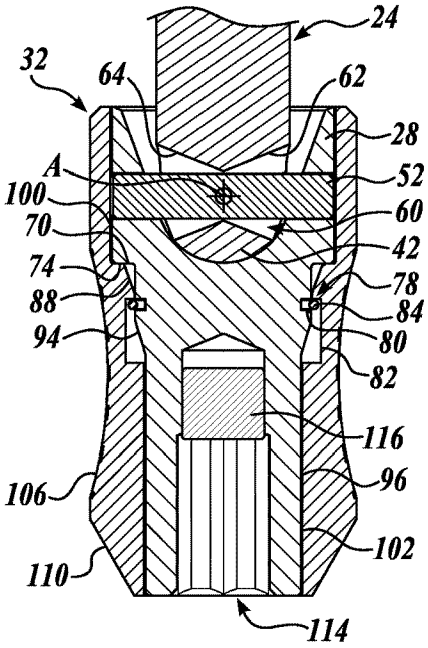
FIG. 5B is a partial cross-sectional view of the tool connector assembly of FIG. 1, wherein the tool connector assembly is shown in a fifth position.
Figure 5A:
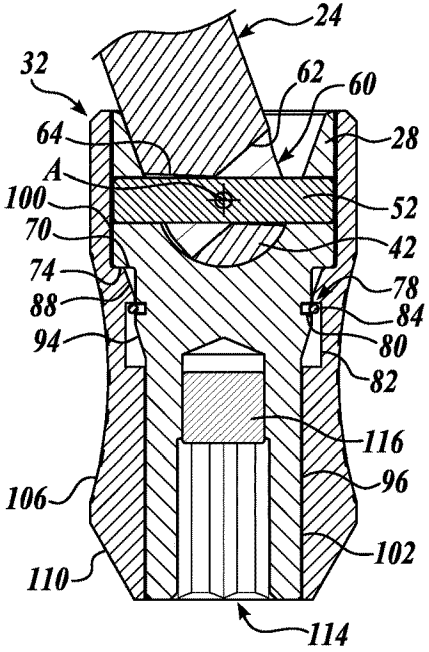
FIG. 5A is a partial cross-sectional view of the tool connector assembly of FIG. 1, wherein the tool connector assembly is shown in a fourth position.

Moreover, the ball portion 42 of the first drive shaft 24 may rotate about the longitudinal axis of the cross pin 52 between at least first and second off-axis positions relative to the second drive shaft 28. Specifically, the first drive shaft 24 may rotate about the axis of the cross pin 52 between at least a first off-axis position defined by the angle of the cup-shaped cavity 44, as shown in FIG. 4A, and a second diametrically opposite off-axis position defined by the angle of the cup-shaped cavity 44. Accordingly, it can be appreciated that the angle of the tapered walls of the cup-shaped cavity 44 may be increased or decreased to increase or decrease, respectively, the off-axis positions of the first drive shaft 24.

The cross pin slot 60 is also shaped to further allow the cross pin 42 to tilt or pivot about an axis transverse to the axis of the cross pin 52, denoted as axis A. Referring to FIGS. 3 and 5A-5C, the cross pin slot 60, which extends within the first drive shaft 24 generally transversely to the longitudinal axis of the drive shaft 24, is defined by first and second opposing generally trapezoidal portions 62 and 64 extending from substantially the center of the first drive shaft 24 outwardly toward the outer surface of the first drive shaft 24.

The first trapezoidal portion 62 is defined within the second end of the first drive shaft 24 such that the tapered end of the trapezoidal shape is located near the center of the first drive shaft and it flares outwardly as it extends toward the outer surface of the first drive shaft 24. In addition, the first trapezoidal portion 62 is defined within the second end of the first drive shaft 24 such that the width of the trapezoidal shape extends along the length of the first drive shaft 24. The edges of the first trapezoidal portion 62 are convexly curved as they meet the outer surface of the first drive shaft 24 for receiving the cross pin 52 as the first drive shaft 24 is pivoted about axis A into a fully off-axis position relative to the second drive shaft 28. The second trapezoidal portion 64 substantially mirrors the first trapezoidal portion 62.

The mirrored first and second trapezoidal portions 62 and 64 of the cross pin slot 60 allow the first drive shaft 24 to tilt or pivot about axis A relative to the second drive shaft 28. The mirrored first and second trapezoidal portions 62 and 64 are shaped and sized to allow the first drive shaft 24 to move into an off-axis position at an angle defined by the cup-shaped cavity 44 at any radial position within a predetermined radial range about the cup-shaped cavity 44. The radial range of the first drive shaft 25 may be defined by the range of movement of the first drive shaft 24 relative to the cross pin 52. The combined ability of the first drive shaft 24 to move about axis A within the radial range and the ability to rotate about the axis of the cross pin 52 gives the first drive shaft 24 substantially three hundred sixty degrees (360°) of rotation relative to the second drive shaft 28 at the off-axis angle defined by the cup-shaped cavity. Accordingly, the first drive shaft 24 may be positioned at substantially any 360° radial position about the cup-shaped cavity 44 at an off-axis angle relative to the second drive shaft 28 that is defined by the cup-shaped cavity 44.

The ball portion 42 and the cup-shaped cavity 44 are made from suitable low-friction materials to allow the first drive shaft 24 to move easily and smoothly into any of the off-axis positions. For instance, the ball portion 42 and/or the cup-shaped cavity 44 may be made from, coated with, or otherwise impregnated with suitable metal(s) (such as bronze, brass, etc.) stabilized polymers ("plastics"), fiber-wound composites, or any other suitable combinations of materials to reduce friction between the parts. In addition, a lubricant may be disposed between the ball portion 42 and the cup-shaped cavity 44 if needed.

In many universal joints, a spring or other friction device is disposed between the ball portion and the cup (or between similar parts) to control movement of the joint and to help stabilize the joint during use with a tool. The friction device may include a compression spring that acts to hold the output portion (such as the second drive shaft) in its position during use. In the tool connector assembly 20 of the present disclosure, however, no friction device is used. Rather, the first drive shaft 24 is permanently connected to the second drive shaft 28, and the ball portion 42 is configured to be directly engageable with the cup-shaped cavity 44 when the first and second drive shafts 24 and 28 are axially misaligned. In other words, the ball joint is defined by a tight but low-friction and moveable connection between the first and second drive shafts 24 and 28 to substantially eliminate or minimize vibration, oscillation, etc., therebetween when connected to a power tool. As such, the ball joint is sufficiently robust for withstanding the high momentary torque of power tools, such as cordless impact drivers.

Moreover, with the ball portion 42 directly engageable with the cup-shaped cavity 44, linear force may be applied from the power tool through the first and second drive shafts 24 and 28 to the tool bit and fastener or similar. More specifically, linear or axial force may be applied from the power tool, through the first drive shaft 24 and into the ball portion 42, through the cup-shaped cavity 44 and into the second drive shaft 28, and thereafter through the tool bit and fastener. As can be appreciated by one skilled in the art, linear or axial force is needed for appropriately driving or removing a fastener into a medium or performing other similar tasks.

However, with no friction device used, the ball joint is configured to easily allow the first drive shaft 24 to move into and out axial alignment with the second drive shaft 28. As such, additional structure is needed to control and stabilize the output portion, or the second drive shaft 28 of the tool connector assembly 20 as it is being used with a power tool (e.g., while driving or removing a fastener). The second shaft 28 is controlled through the use of the hub collar 32. The hub collar 32 is rotatably mounted on the second drive shaft 28 to allow for separate but primarily coaxial rotation relative to the second drive shaft 28. During use of the tool assembly 20, the hub collar 32 is graspable by a user to fix the second drive shaft 28 in its position relative to the first drive shaft 24 while allowing the second drive shaft 28 to rotate freely relative to the hub collar 32 for outputting the torque of the power tool.

Detailed aspects of the second drive shaft 28 and hub collar 32 will now be described. The hub collar 32 is rotatably disposed on the second drive shaft 28 such that the hub collar 32 does not move axially with respect to the second drive shaft 28. In that regard, generally cylindrical features on the exterior of the second drive shaft 28 interact with generally cylindrical features on the interior of the hub collar 32. Although any suitable mating configuration may be used to rotatably secure the hub collar 32 on the second drive shaft 28, in the depicted embodiment, the hub collar 32 includes an internal cavity 90 defined by several internal bores of differing diameters that are sized to receive cylindrical portions of the second drive shaft 28 having various corresponding diameters.

Specifically, the second drive shaft 28 includes a first enlarged cylindrical portion 68 surrounding the cup-shaped cavity 44 that extends from an upper end of the second drive shaft 28 and terminates in a second drive shaft shoulder 70. The second drive shaft 28 further includes a first reduced diameter cylindrical portion 92 extending from the first enlarged cylindrical portion 68, wherein the second drive shaft shoulder 70 is defined therebetween. Extending from the first reduced diameter cylindrical portion 92 is a second reduced diameter cylindrical portion 96, with a first annular ramp 94 extending therebetween.

The internal bores of the hub collar 32 are generally correspondingly configured in size and shape to match the cylindrical portions 68, 92, and 96 of the second drive shaft 28. In that regard, the hub collar 32 includes an enlarged bore 100 at its first or upper end that is sized and configured to receive the enlarged cylindrical portion 68 of the second drive shaft 28. Extending downwardly therefrom is a second annular ramp 88, with an internal hub collar shoulder 74 defined between the enlarged bore 100 and the second annular ramp 88. A reduced diameter bore 102 is defined at the second end of the hub collar 32 that is configured to rotatably receive the second reduced diameter cylindrical portion 96 of the second drive shaft 28. The overall length of the second drive shaft 28 and the hub collar 32 are substantially equal such that the drive shaft 28 and the hub collar 32 are substantially flush at their first and second ends when mated.

To facilitate rotation between the hub collar 32 and the second drive shaft 28, at least one of the interior surface of the hub collar 32 and the exterior surface of the second drive shaft 28 are made from or coated with suitable materials to minimize friction therebetween. In other words, the hub collar 32 is configured to essentially act as a bushing on the second drive shaft 28. In that regard, the hub collar 32 may be made from, coated with, or otherwise impregnated with suitable metal(s) (such as bronze, brass, etc.) stabilized polymers ("plastics"), fiber-wound composites, or any other suitable combinations of materials. In addition, a lubricant may be disposed between the hub collar 32 and the second drive shaft 28 if needed.

Although rotatable with respect to the second drive shaft 28, the hub collar 32 is substantially fixed in its axial position relative to the second drive shaft 28. In that regard, the second drive shaft 28 is securable within the hub collar 32 such that the second drive shaft shoulder 70 engages the inner hub collar shoulder 74 to limit the axial inward movement of the second drive shaft 28 relative to the hub collar 32.

A locking mechanism 78 is defined between the interior of the hub collar 32 and the exterior of the second drive shaft 28 to substantially limit axial movement of the second drive shaft 28 in the opposite outward direction. Although any suitable locking mechanism may be used to limit outward axial movement of the second drive shaft 28 with respect to the hub collar 32, in the depicted embodiment, the locking mechanism 78 is defined by a first annular groove 80 formed within the first reduced diameter cylindrical portion 92 on the exterior of the second drive shaft 28 and a second annular groove 82 formed on the interior of the hub collar 32 that extends between the second annular ramp 88 and the reduced diameter bore 102. The first annular groove 80 is in substantial axial alignment with the second annular groove 82 when the second drive shaft 28 is fully received within the hub collar 32 (i.e., the internal hub collar shoulder 74 is engaged with the second drive shaft shoulder 70).

The locking mechanism 78 further includes a spring clip 84 disposed within the first annular groove 80 when compressed. The spring clip 84 is C-shaped or another suitable shape such that it is urged into an extended position when the first annular groove 80 is aligned with the second annular groove 82. The spring clip 84 is sized and configured such that it will extend partially into the second annular groove 82 when the first and second annular grooves 80 and 82 are aligned. As such, the spring clip 84 is disposed partially within each of the first and second annual grooves 80 and 82 when aligned, thereby substantially preventing axial movement of the second drive shaft 28 in the outward direction relative to the hub collar 32. Accordingly, the locking mechanism 74, in cooperation with the interaction of the shoulders 70 and 74, secures the second drive shaft 28 axially within the hub collar 32 such that the hub collar 32 stays secured on the second drive shaft 28 during use.

The second annular ramp 88 helps urge the spring clip 84 into the first annular groove 80 as the second drive shaft 28 is moved axially into the hub collar 32. The second annular ramp 88 urges the spring clip 84 into the first annular groove 80 when a predetermined axial force is exerted on the hub collar 32 or the second drive shaft 28 during assembly.

As noted above, the hub collar 32 is used to control and stabilize the tool connector assembly 20 as it is being used with a power tool, for instance, to drive or remove a fastener. When the hub collar 32 is grasped by the user during use, the user has control over the output end of the tool assembly 20 (i.e., the second drive shaft 28) such that torque and linear force may be applied to a fastener or the like when connected to a power tool. Specifically, a user may grasp the hub collar 32 with one hand, position the first drive shaft 24 at a suitable off-axis angle relative to the second drive shaft 28, and apply high momentary torque from the power tool held in the other hand.

In that regard, the exterior of the hub collar 32 is suitably shaped to be graspable by a user. Although any suitable shape may be used, the exterior of the hub collar 32 is generally cylindrical in overall shape with a concave portion 106 extending along at least a portion of the length of the hub collar 32. The concave portion 106 is generally sized to be graspable by a user during use. The second or lower end of the hub collar 32 may include a tapered portion 110 for giving increased visibility to a drive bit or other tool piece received within the second drive shaft 28 during use.

In that regard, the second drive shaft 28 includes a bit receptacle 114 formed in its second or lower end opposite the cup-shaped cavity 44. The bit receptacle 114 is suitably sized and shaped to removably receive an attachment portion of a tool piece or insert bit therein (not shown). For instance, the bit receptacle 114 may be hexagonal in shape, such as ¼" hex opening, to receive a correspondingly sized hex shank of an insert bit. Although the bit receptacle 114 is shown as polygonal or hex shaped, it should be appreciated that the bit receptacle 114 may be any suitable shape to receive any suitable drive bit therein, such as bits having any suitable drive head (e.g., Phillips, Torx, Allen, flat head, etc.).

The drive bit or other tool piece may be removably secured within the bit receptacle 114 in any suitable manner. Preferably, the second drive shaft 28 and the drive bit are made from suitable metals such that the drive bit is magnetically retained within the bit receptacle 114 in a manner well known in the art. For instance, in the embodiment illustrated, a magnet 116 is disposed within the bit receptacle 114. In the alternative, the second drive shaft 28 may include a ball detent or similar mechanism that selectively interferes with one or more detents formed on the exterior surface of the hex shank of the drive bit to removably secure the drive bit therein. The magnet 116 also helps magnetically retain a fastener, such as a screw, on the driving end of the drive bit in a manner well known in the art.

As noted above, the first drive shaft 24 includes a threaded body portion 38 configured to threadably receive first and second locking collars 46 and 48 thereon. The first and second locking collars 46 and 48 are configured to either lock the first drive shaft 24 in coaxial alignment with the second drive shaft 28 or to define and limit the axial misalignment of the first drive shaft 24 relative to the second drive shaft 28. In that regard, the first locking collar 46 includes a cylindrical body having a first end and a second end configured to abut the first end of the second locking collar 48 in a locked position. The second locking collar 48 generally includes a cylindrical body with a first end that is configured to abut or engage a second end of the first locking collar 46, and a second opposite tapered end 120 that is configured to be disposed at least partially within the cup-shaped cavity 44. A suitable sealing element, such as an O-ring, may be disposed between the first and second locking collars 46 and 48. If an O-ring is used, the first and second locking collars 46 and 48 would be considered engaged by each engaging the O-ring disposed therebetween. The tapered end 120 of the second locking collar 48 may be moved into and out of engagement with the cup-shaped cavity 44 to limit the axial misalignment of the first drive shaft 24 relative to the second drive shaft 28.

Referring to FIGS. 4A-4C, with the second locking collar 48 out of engagement with the cup-shaped cavity 44, the first drive shaft 24 may be moved out of axial alignment relative to the second drive shaft 28 the maximum amount defined by the angle the cup-shaped cavity 44. This full degree of movement can be seen in FIG. 4A. Referring to FIG. 4B, the second locking collar 48 may be threadably moved along the first drive shaft 24 toward the second drive shaft 28 until its tapered end 120 is at least partially received within the cup-shaped cavity. In such a configuration, the first drive shaft 24 may be moved only partially out of coaxial alignment with the second drive shaft 28 due to the interference of the second locking collar 48 and the cup-shaped cavity 44.

Referring to FIG. 4C, the second locking collar 48 may be threaded and moved axially along the first drive shaft 24 until its tapered end 120 is fully received within the cup-shaped cavity 44 of the second drive shaft 28. In such a configuration, the first drive shaft 24 is secured coaxially to the second drive shaft 28 for using the tool connector 20 without any axial misalignment.

The second locking collar 48 may be secured in its axial position along the first drive shaft 24 with use of the first locking collar 46. More specifically, the first locking collar 46 may be threaded along the first drive shaft 24 until its second end abuts the first end of the second locking collar 48 to prevent the second locking collar 48 from moving upward axially along the drive shaft 24. Further, the first and second locking collars 46 and 48 may be counter-threaded such that they are tightened in opposite directions (i.e., the first locking collar 46 is a jam nut). For instance, the first locking collar 46 may be tightened by turning the first locking collar 46 counterclockwise, and the second locking collar 48 may be tightened by turning it clockwise. Opposite threading may instead be used. As such, when the first locking collar 46 is moved into engagement with the second locking collar 48 in opposite rotational directions, a locking engagement is defined therebetween. With the first and second locking collars 46 and 48 engaged with one another with at least the force of a hand turn, the second locking collar 48 is prevented from moving axially along the first drive shaft 24, and the axial alignment or misalignment of the first drive shaft 24 with respect to the second drive shaft 28 is temporarily fixed.

Figure 6:
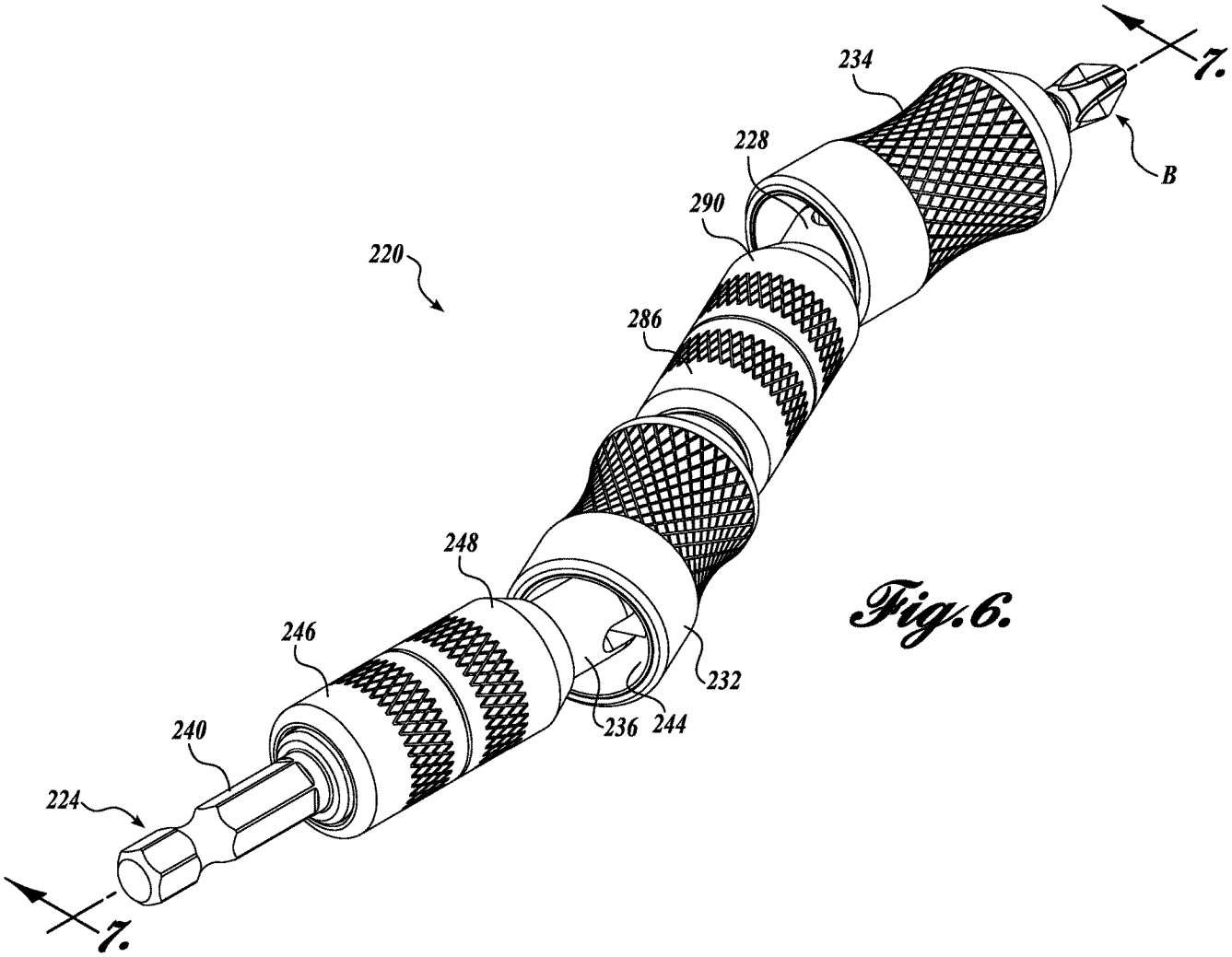
FIG. 6 is an isometric environmental view of a tool connector assembly formed in accordance with a second exemplary embodiment of the present disclosure.
Figure 7:
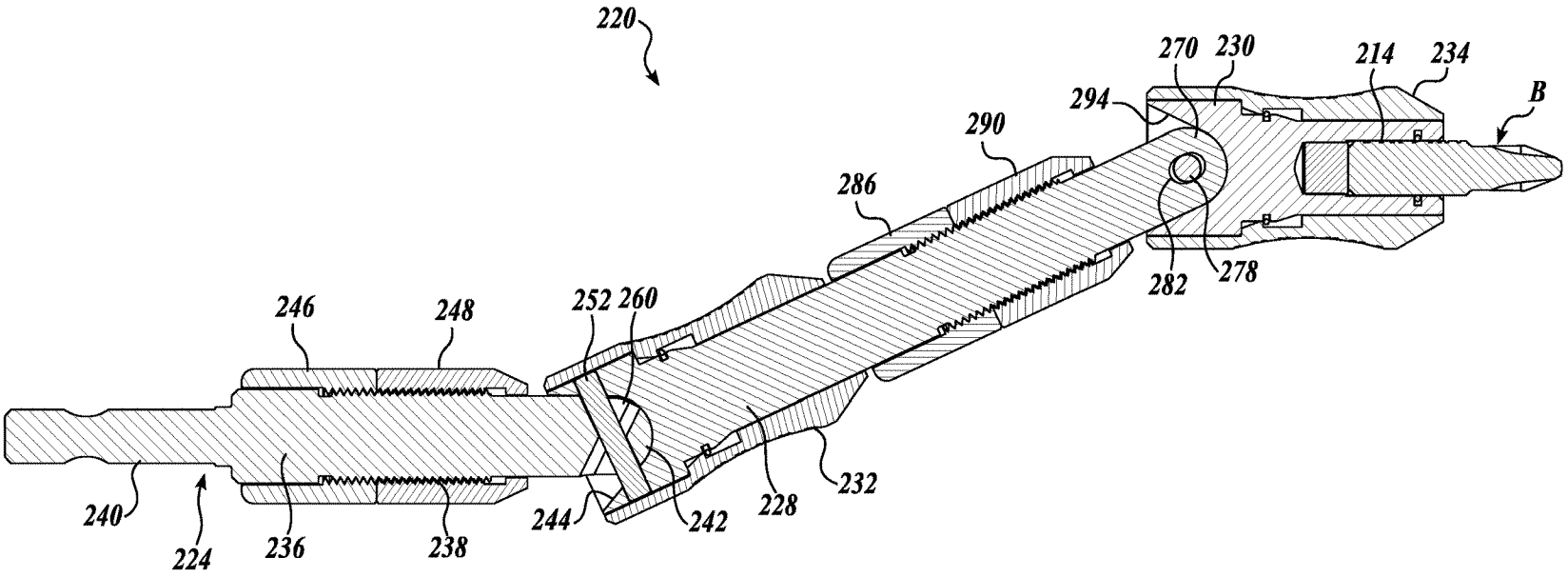
FIG. 7 is a cross-sectional view of the tool connector assembly of FIG. 6, taken substantially across line 7-7.

Referring to FIGS. 6 and 7, a first alternate exemplary embodiment of a tool connector assembly 220 is depicted. The tool connector assembly 220 is substantially identical to the tool connector assembly 20 described above; and therefore, certain like parts will be referenced with like numerals except in the '200 series. The tool connector assembly 220 generally includes a first drive shaft 224 movably coupled to a second drive shaft 228, and a third drive shaft 230 movably coupled to the second drive shaft 228. The first drive shaft 224 is connectable to a power tool, and the third drive shaft 230 is configured to removably receive a tool bit or otherwise define a tool end for completing a mechanical task. The second drive shaft 228 is configured to movably couple the third drive shaft 230 to the first drive shaft 224. The first drive shaft 224 may be positioned out of coaxial alignment with the second drive shaft 228 (or vice versa), and the second drive shaft 228 may be positioned out of coaxial alignment with the third drive shaft 230 (or vice versa) for driving and removing fasteners or the like at an angle from a power tool.

The first drive shaft 224 of the tool connector assembly 220, which is substantially identical to the first drive shaft 24 of the tool connector assembly 20, will first be briefly described. The first drive shaft 224 includes a tool attachment portion 240 defined at its first end that is generally configured for attaching to a power tool, such as an impact driver, a standard hand drill, or similar tool. The first drive shaft 224 further includes an elongated body portion 236 extending coaxially from the tool attachment portion 240 a suitable, predetermined length for the intended application. The elongated body portion 236 may optionally include a threaded body portion 238 defined near a second end of the first drive shaft 224 for threadably receiving first and second locking collars 246 and 248 thereon. In the depicted embodiment, the first and second locking collars 246 and 248 are substantially identical to the first and second locking collars 46 and 48 described above.

The second end of the first drive shaft 224 terminates in a ball portion 242 configured to be movably received within a cup-shaped cavity 244 defined with a first end of the second drive shaft 228. The cup-shaped cavity 244 receives the ball portion 242 to define a universal ball and socket type joint between the first and second drive shafts 224 and 228, in a substantially identical manner as that described above with respect to the tool connector assembly 20. In that regard, the ball portion 242 is movably secured within the cup-shaped cavity 244 by passing a cross pin 252 through a cross pin slot 260 defined within the ball portion 242 with the ends received within first and second openings (not labeled) in the second drive shaft 228. Similar to that described above with the tool connector assembly 20, the first drive shaft 224 may be positioned at substantially any radial position about the cup-shaped cavity 244 at an off axis angle relative to the second drive shaft 228 that is defined by the cup-shaped cavity 244. Moreover, the first and second locking collars 246 and 248 may be used to either lock the second drive shaft 228 in coaxial alignment with the first drive shaft 236 or to define and limit the axial misalignment of the second drive shaft 228 relative to the first drive shaft 224.

The second drive shaft 228 may be controlled and stabilized through the use of a first hub collar 232. The first hub collar 232 is rotatably mounted on the first end of the second drive shaft 228 to allow for separate but primarily coaxial rotation of the first hub collar 232 relative to the second drive shaft 228. During use of the tool assembly 220, the first hub collar 232 is graspable by a user to fix the second drive shaft 228 in its off-axis position relative to the first drive shaft 224 while allowing the second drive shaft 228 to rotate freely for outputting the torque of the power tool. The first hub collar 232 is substantially identical to the hub collar 32 described above; and therefore, detailed aspects of how the first hub collar 232 is rotatably secured on the second drive shaft 228 will not be provided.

As noted above, the second drive shaft 228 is movably coupled to a third drive shaft 230. The second drive shaft 228 is movably coupled to the third drive shaft 230 in a substantially identical manner to the coupling of the first drive shaft 224 to the second drive shaft 228. In that regard, the distal or second end of the second drive shaft 228 includes a ball portion 270 that is movably secured within a cup-shaped cavity 274 defined within a first end of the third drive shaft 230. A universal ball and socket type joint is therefore defined between the second and third drive shafts 228 and 230. The ball portion 270 is secured within the cup-shaped cavity 274 with a cross pin 278 extending diametrically through a cross pin slot 280 defined in the ball portion 270 and received within first and second opposing holes (not shown or labeled) defined within the first end of the third drive shaft 230. However, in this exemplary tool connector assembly embodiment, the second cross pin 278 is positioned substantially transversely to the first cross pin 252 to help provide a smoother range of movement of the tool connector assembly 220 and less vibration while rotating at higher RPM.

The third drive shaft 230 includes a bit receptacle 214 formed in the second end opposite the cup-shaped cavity 274. The bit receptacle 214 is suitably sized and shaped to removably receive an attachment portion of a tool piece, such as an insert bit B therein. The insert bit B may be removably secured within the bit receptacle 214 in any suitable manner, such as in the manner described above with respect to the bit receptacle 114.

A second hub collar 234 is rotatably secured on the third drive shaft 230 and is graspable by a user to stabilize and control the third drive shaft 230 relative to the second drive shaft 228 as it is used to impart an off-axis force against a fastener. The second hub collar 234 is substantially identical to the hub collar 32 described above; and therefore, the detailed configuration of the second hub collar 234 and the manner in which it is secured on the third drive shaft 230 will not be described in detail.

When in use, the second hub collar 234 may be grasped by a user to control and stabilize the third drive shaft 230 relative to the second drive shaft 228 for driving or removing a fastener. When the second hub collar 230 is grasped by the user during use, the user has control over the output end of the tool assembly 220 (i.e., the third drive shaft 230) such that torque and linear force may be applied to a fastener or the like when connected to a power tool. Specifically, a user may grasp the second hub collar 234 with one hand, position the second drive shaft 228 at a suitable off-axis angle relative to the third drive shaft 230, and apply high momentary torque from the power tool held in the other hand.

The second drive shaft 228 may also include third and fourth locking collars 286 and 290 threadably disposed on a second end of the second drive shaft 228. The third and fourth locking collars 286 and 290 are substantially identical to the first and second locking collars 246 and 248 in that they are configured to either lock the second drive shaft 228 in coaxial alignment with the third drive shaft 230 or they can be used to define and limit the axial misalignment of the second drive shaft 228 relative to the third drive shaft 230.

Figure 8:
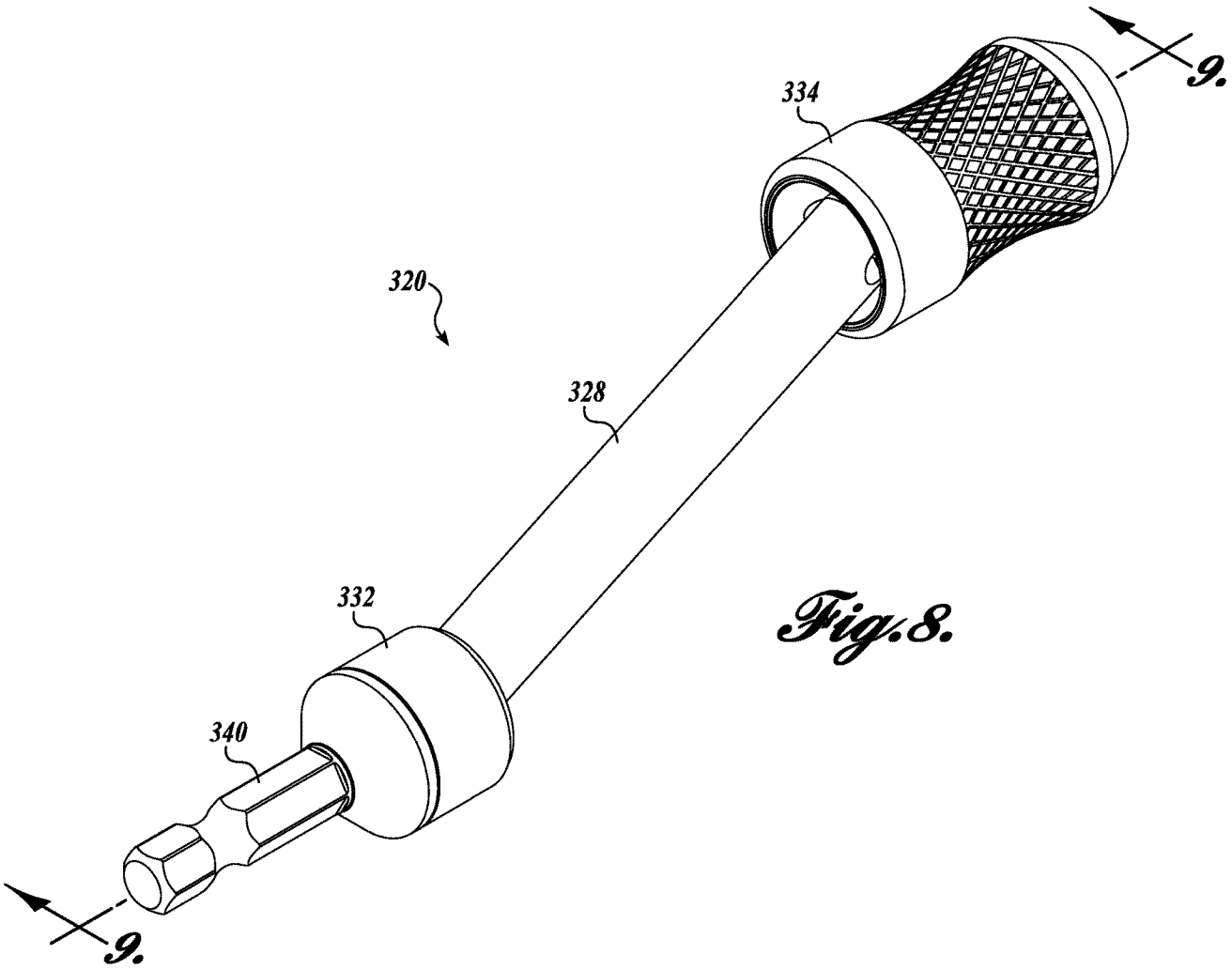
FIG. 8 is an isometric environmental view of a tool connector assembly formed in accordance with a third exemplary embodiment of the present disclosure.
Figure 9:
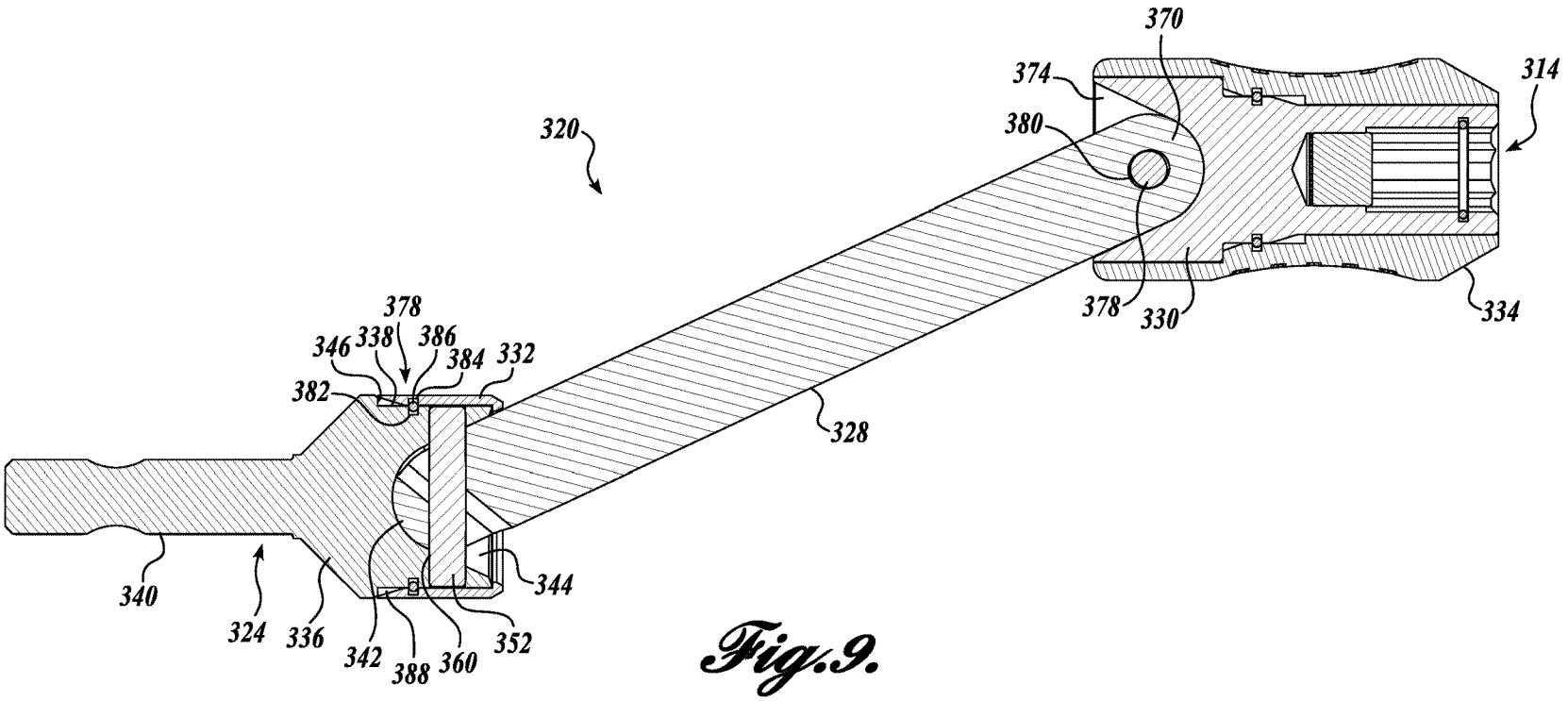
FIG. 9 is a cross-sectional view of the tool connector assembly of FIG. 8, taken substantially across line 9-9.

Referring to FIGS. 8 and 9, a second alternate exemplary embodiment of the tool connector assembly 320 is depicted. The tool connector assembly 320 is similar to the tool connectors 20 and 220 described above; and therefore, certain like parts will be referenced with like numerals except in the '300 series. The tool connector assembly 320 generally includes a first drive shaft 324 movably coupled to a second drive shaft 328 and a third drive shaft 330 movably coupled to the second drive shaft 328, wherein the first drive shaft 324 is connectable to a power tool, and the third drive shaft 330 is configured to removably receive a tool bit or otherwise define a tool end for completing a mechanical task.

It should be appreciated that the terms "first", "second", and "third" used to refer to the drive shafts 324, 328, and 330 are merely for identification purposes only, and the drive shafts 324, 328, and 330 may instead be referred to as the first, third, and second drive shafts 324, 328, and 330 (such as by saying that the third drive shaft 328 is moveably secured between the first and second drive shafts 324 and 330.) Accordingly, the terms "first", "second", and "third" should not be seen as limiting.

The tool connector assembly 320 of FIGS. 8 and 9 differs from the tool connector assembly 220 described above with reference to FIGS. 6 and 7 in that the second drive shaft 328 terminates in a ball portion 342 at its first end that is configured to be movably secured within a cup-shaped cavity 344 defined within the second end of the first drive shaft 324.

In that regard, the first drive shaft 324 includes a tool attachment portion 340 defined at a first end that is generally configured for attaching to a power tool or the like. A body portion 336 extends coaxially from the tool attachment portion 340 a suitable, predetermined length for the intended use. Unlike the body portions 36 and 236 described above, however, the body portion 336 is sized and configured to define a cup-shaped cavity 344 in the second end of the first drive shaft 324 for movably receiving a first end of the second drive shaft 328.

The ball portion 342 of the second drive shaft 328 is movably secured within the cup-shaped cavity 344 in a manner similar to that described above with respect to the first cup-shaped cavity 244 and the first ball portion 242 of the tool connector assembly 220. In this regard, a cross pin 252 extends diametrically through a cross pin slot 360 defined in the first ball portion 342 and is received within first and second holes (not labeled) defined within the body portion 336 of the first drive shaft 324.

The first drive shaft 324 may be controlled and stabilized through the use of a first hub collar 332 rotatably disposed on the second end of the first drive shaft 324. In this exemplary embodiment, the first hub collar 332 is simply a cylindrical member having an internal diameter that is substantially the same size as an exterior diameter of the second end of the first drive shaft 324. The first hub collar 332 may be received within an annular recess 338 defined within the body portion 336 such that the exterior diameter of the first hub collar 332 is substantially the same size as the exterior diameter of the body portion 336. It should be appreciated that the first hub collar 332 may instead include an exterior contoured surface similar to the hub collars 32, 232, and 234 shown and described above.

The annular recess 338 defines a shoulder 342 against which a first or upper end of the first hub collar 332 may be engaged for substantially fixing the axial position of the first hub collar 332 relative to the first drive shaft 324 in a first axial direction. Moreover, a locking mechanism 378 may be defined between the interior of the first hub collar 332 and the exterior of the first drive shaft 324 to substantially limit axial movement of the first hub collar 332 relative to the first drive shaft 324 in a second opposite axial direction. Although any suitable locking mechanism may be used, in the depicted embodiment, the locking mechanism 378 is defined by a first annular groove 382 formed within the exterior of the body portion 336 and a second annular groove 384 formed on the interior of the first hub collar 332. The first annular groove 382 is in substantial axial alignment with the second annular groove 384 when the first hub collar 332 is fully received on the first drive shaft 324 (i.e., the first end of the first hub collar 332 is engaged with the first shoulder 346).

The locking mechanism 378 further includes a spring clip 386 that is C-shaped or another suitable shape and is disposed within the first annular groove 382 when compressed. The spring clip 386 is urged into an extended position when the first annular groove 382 aligns with the second annular groove 384. More specifically, the spring clip 386 is sized and configured such that it will extend partially into the second annular groove 384 when the first and second annular grooves 382 and 384 are aligned. With the spring clip 384 partially disposed within each of the first and second annular grooves 382 and 384, axial movement of the first hub collar 332 relative to the first drive shaft 324 is substantially prevented.

An internal annular ramp 388 is defined within the interior of the first end of the first hub collar 332 to help urge the spring clip 386 into the first annular groove 382 as the first hub collar 332 is moved axially onto the first drive shaft 324. The annular ramp 388 urges the spring clip 386 into the first annular groove 382 when a predetermined axial force is exerted on the first hub collar 332 or the first drive shaft 324 during assembly.

The first hub collar 332 may be used to control and stabilize the first drive shaft 324 as it is being used with the power tool. During use of the tool assembly 320, the first hub collar 332 is graspable by a user to fix the second drive shaft 328 in its off-axis position relative to the first drive shaft 324 while allowing the second drive shaft 328 to rotate freely for outputting the torque of the power tool.

The second drive shaft 328 may also include locking collars (not shown) threadably disposed thereon that are configured to either lock the second drive shaft 328 in coaxial alignment with the first drive shaft 324 or for defining and limiting the axial misalignment of the second drive shaft 328 relative to the first drive shaft 324.

As noted above, the second drive shaft 328 is movably coupled to a third drive shaft 230. The second drive shaft 328 is movably coupled to the third drive shaft 330 in a substantially identical manner to the coupling of the first drive shaft 324 to the second drive shaft 328. In that regard, the distal or second end of the second drive shaft 328 includes a ball portion 370 that is movably secured within a cup-shaped cavity 374 defined within a first end of the third drive shaft 330. A universal ball and socket type joint is therefore defined between the second and third drive shafts 328 and 330. The ball portion 370 is secured within the cup-shaped cavity 374 with a cross pin 378 extending diametrically through a cross pin slot 380 defined in the ball portion 370 and received within first and second opposing holes (not shown or labeled) defined within the first end of the third drive shaft 330. However, in this exemplary tool connector assembly embodiment, the second cross pin 378 is positioned substantially transversely to the first cross pin 352 to help provide a smoother range of movement of the tool connector assembly 320 and less vibration while rotating at higher RPM.

The third drive shaft 330 includes a bit receptacle 314 formed in the second end opposite the cup-shaped cavity 374. The bit receptacle 314 is suitably sized and shaped to removably receive an attachment portion of a tool piece, such as an insert bit (not shown) therein. The insert bit may be removably secured within the bit receptacle 314 in any suitable manner, such as in the manner described above with respect to the bit receptacle 114.

A second hub collar 334 is rotatably secured on the third drive shaft 330 and is graspable by a user to stabilize and control the third drive shaft 330 as it is used to impart an off-axis force against a fastener. The second hub collar 334 is substantially identical to the hub collar 32 described above; and therefore, the detailed configuration of the second hub collar 334 and the manner in which it is secured on the third drive shaft 330 will not be described in detail.

When in use, the second hub collar 334 may be grasped by a user to control and stabilize the third drive shaft 330 relative to the second drive shaft 328 for driving or removing a fastener. When the second hub collar 330 is grasped by the user during use, the user has control over the output end of the tool assembly 320 (i.e., the third drive shaft 330) such that torque and linear force may be applied to a fastener or the like when connected to a power tool. Specifically, a user may grasp the second hub collar 334 with one hand, position the second drive shaft 328 at a suitable off-axis angle relative to the third drive shaft 330, and apply high momentary torque from the power tool held in the other hand.

The second drive shaft 328 may also include locking collars (not shown) threadably disposed thereon that are configured to either lock the second drive shaft 328 in coaxial alignment with the third drive shaft 330 or for defining and limiting the axial misalignment of the second drive shaft 328 relative to the third drive shaft 330.

The detailed description set forth above in connection with the appended drawings is intended as a description of exemplary embodiments of a tool connector assembly and are not intended to represent the only embodiments. The representative embodiments described in this disclosure are provided merely as an example or illustration and are not intended to be exhaustive or to limit the claimed subject matter to the precise forms disclosed.

In the foregoing description, numerous specific details are set forth in order to provide a thorough understanding of the exemplary embodiments of the present disclosure. It will be apparent to one skilled in the art, however, that the exemplary embodiments of the present disclosure may be practiced without some or all of the specific details. In some instances, well-known process steps or features have not been described in detail in order not to unnecessarily obscure various aspects of the present disclosure. Further, it will be appreciated that the exemplary embodiments of the present disclosure may employ any combination of features described herein.

For ease of illustration and clarity, the connector assembly 20 is mostly shown in a substantially vertical orientation, although it may be suitably used in any orientation, such as horizontal. Likewise, the connector assemblies 220 and 320 are mostly shown in a substantially horizontal orientation, although it may be suitably used in any orientation, such as vertical. Therefore, terminology, such as "front," "rear," "inward," "outward," "forward," "rearward," "front," "back," "upward," "downward," "lateral," "medial," "in," "out," "extended," "advanced," "retracted," "proximal," "distal," "central," etc., should be construed as merely descriptive and not limiting. These references, and other similar references in the present disclosure, are only to assist in helping describe and understand the particular embodiment and are not intended to limit the present disclosure to these directions or locations. Further, although certain geometric shapes may be illustrated and described, it should be understood that such terms are intended to be merely descriptive and not limiting. Hence, other geometric shapes, such as oval, round, square, etc., are also within the scope of the present disclosure.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. In an embodiment, "about," "approximately," "substantially," etc., means plus or minus 5% of the stated value.

While illustrative embodiments have been illustrated and described, it will be appreciated that various changes can be made therein without departing from the spirit and scope of the invention.

The invention claimed is:

1. A tool connector assembly for transmission of off-axis torque from a power tool, the assembly comprising:

a first drive shaft having a first end configured to be secured within a power tool and a second end defining a ball portion having a circular cross-sectional shape;

a second drive shaft having a first end defining a cup-shaped cavity configured to receive the ball portion such that the ball portion is moveable against a spherical surface of the cup-shaped cavity for moveably coupling the first drive shaft to the second drive shaft, the second drive shaft further having a second end defining an internal cavity configured to receive a tool bit; and a hub collar received on the second drive shaft and rotatable about a longitudinal axis of the second drive shaft.

2. The assembly of claim 1, wherein the hub collar is substantially fixed in its linear position on the second drive shaft.

3. The assembly of claim 1, wherein the hub collar is graspable by a user when the tool connector assembly is being driven by a power tool.

4. The assembly of claim 1, wherein the entire ball portion is capable of being in direct physical contact with the surface of the cup-shaped cavity.

5. The assembly of claim 1, further comprising a first locking nut threadably disposed on the first drive shaft, the first locking nut selectively engageable with the cup-shaped cavity to selectively limit off-axis movement of the first drive shaft relative to the second drive shaft.

6. The assembly of claim 5, wherein the first locking nut is engageable with the cup-shaped cavity to substantially coaxially align the first drive shaft with the second drive shaft for transmission of coaxial torque from a power tool.

7. The assembly of claim 5, further comprising a second locking nut threadably disposed on the first drive shaft, the second locking nut selectively engageable with the first locking nut to secure the first locking nut in its substantially axial position on the first drive shaft.

8. A tool connector assembly for transmission of off-axis torque from a power tool, the assembly comprising:

a first drive shaft having a first end configured to be secured within a power tool and a second end defining a first ball portion;

a second drive shaft having a first end defining a first cup-shaped cavity configured to receive the first ball portion such that the first ball portion is moveable against a surface of the first cup-shaped cavity for moveably coupling the first drive shaft to the second drive shaft, the second drive shaft further having a second end defining a second ball portion;

a third drive shaft having a first end defining a second cup-shaped cavity configured to receive the second ball portion such that the second ball portion is moveable against a surface of the second cup-shaped cavity for moveably coupling the second drive shaft to the third drive shaft, the third drive shaft further having a second end defining an internal cavity configured to receive a tool bit; and a first hub collar received on the third drive shaft and rotatable about a longitudinal axis of the third drive shaft.

9. The assembly of claim 8, wherein the first hub collar is substantially fixed in its linear position on the third drive shaft.

10. The assembly of claim 8, further comprising a second hub collar received on the second drive shaft and rotatable about a longitudinal axis of the second drive shaft.

11. The assembly of claim 8, wherein the entire first ball portion is capable of being in direct physical contact with the surface of the first cup-shaped cavity, and wherein the entire second ball portion is capable of being in direct physical contact with the surface of the second cup-shaped cavity.

12. The assembly of claim 8, further comprising a first locking nut threadably disposed on the first drive shaft, the first locking nut selectively engageable with the first cup-shaped cavity to variably limit off-axis movement of the first drive shaft relative to the second drive shaft.

13. The assembly of claim 12, wherein the first locking nut is engageable with the first cup-shaped cavity to substantially coaxially align the first drive shaft with the second drive shaft for transmission of coaxial torque from a power tool.

14. The assembly of claim 12, further comprising a second locking nut threadably disposed on the first drive shaft, the second locking nut selectively engageable with the first locking nut to secure the first locking nut in its substantially axial position on the first drive shaft.

15. A tool connector assembly for transmission of off-axis torque from a power tool, the assembly comprising:

a first drive shaft having a first end configured to be secured within a power tool and a second end defining a first cup-shaped cavity;

a second drive shaft having a first end defining a second cup-shaped cavity and a second end defining an internal cavity configured to receive a tool bit;

a third drive shaft having a first end defining a first ball portion that is moveably receivable within the first cup-shaped cavity such that the first ball portion is moveable against a surface of the first cup-shaped cavity for moveably coupling the third drive shaft to the first drive shaft, the third drive shaft further having a second end defining a second ball portion that is moveably receivable within the second cup-shaped cavity such that the second ball portion is moveable against a surface of the second cup-shaped cavity for moveably coupling the third drive shaft to the second drive shaft; and a first hub collar received on the second drive shaft and rotatable about a longitudinal axis of the second drive shaft.

16. The assembly of claim 15, wherein the first hub collar is substantially fixed in its linear position on the second drive shaft.

17. The assembly of claim 15, further comprising a second hub collar received on the first drive shaft and rotatable about a longitudinal axis of the first drive shaft.

18. The assembly of claim 15, wherein the entire first ball portion is capable of being in direct physical contact with the surface of the first cup-shaped cavity, and wherein the entire second ball portion is capable of being in direct physical contact with the surface of the second cup-shaped cavity.

19. The assembly of claim 18, wherein the first ball portion is moveably retained within the first cup-shaped cavity by passing a first cross pin through the first drive shaft and the first ball portion, and wherein the second ball portion is moveably retained within the second cup-shaped cavity by passing a second cross pin through the third drive shaft and the second ball portion.

* * * * *